United States Patent [19]

Barnes

[11] Patent Number: 4,733,836

[45] Date of Patent: Mar. 29, 1988

[54] NURSING BOTTLE HOLDER

[76] Inventor: Robert J. Barnes, 937 Springdale, Bedford, Tex. 76021

[21] Appl. No.: 887,810

[22] Filed: Jul. 21, 1986

[51] Int. Cl.[4] ..... A47D 15/00

[52] U.S. Cl. ..... 248/106; 248/122; 5/431; 5/465

[58] Field of Search ..... 248/461, 102, 104, 105–107, 248/121–122, 124, 174, 346; 5/431–433, 437, 442, 443, 465

[56] References Cited

U.S. PATENT DOCUMENTS

| | | | |
|---|---|---|---|
| 814,654 | 3/1906 | Kee | 5/465 |
| 1,786,459 | 12/1930 | Simons | 248/104 |
| 2,451,718 | 10/1948 | Corrao | 248/105 |
| 2,631,288 | 3/1953 | Daust | 248/102 |
| 2,681,782 | 6/1954 | Morishita . | |
| 2,909,345 | 10/1959 | Matsuoka . | |
| 3,121,884 | 2/1964 | Emery | 5/433 |
| 3,519,231 | 7/1970 | Miller . | |
| 4,114,847 | 9/1978 | Bogensberger . | |
| 4,538,310 | 9/1985 | Scott | 5/432 |

FOREIGN PATENT DOCUMENTS

| | | | |
|---|---|---|---|
| 404796 | 10/1968 | Australia | 5/465 |
| 1449012 | 7/1966 | France | 5/431 |
| 1247 | of 1904 | United Kingdom | 5/465 |
| 1444873 | 8/1976 | United Kingdom | 248/105 |

*Primary Examiner*—J. Franklin Foss
*Assistant Examiner*—Robert A. Olson

[57] ABSTRACT

A nursing bottle holder allows an infant to rest on his side while nursing from a bottle. The bottle holder includes an inclined front wall. The front wall is supported at an inclination relative to the level surface to support the infant on his side. A flexible stem with a bottle retainer on its end allows a bottle to be positioned for holding the bottle while the infant drinks. The front wall is part of a compartment used to hold infant accessories.

4 Claims, 4 Drawing Figures

NURSING BOTTLE HOLDER

BACKGROUND OF THE INVENTION

1. Field of the Invention:

This invention relates in general to accessories for infants, and in particular to a device for holding a bottle for a nursing infant.

2. Description of the Prior Art:

Nursing or feeding an infant with a bottle is a time consuming task. Holding the infant in one's arms and holding the bottle is certainly rewarding, but it can take as long as forty-five minutes for the infant to feed. Most parents of infants do not have assistance in the home, and therefore have many other tasks to do.

When the infant is a little older, the parent might prop the bottle up with pillows in an attempt to let the baby feed while the parent engages in some othr task. This is not very satisfactory. Often, the bottle will fall to one side. Also, it is possible for the infant to choke on the milk or to spill the milk on him. Also, with very young infants, it is very difficult to accomplish.

There are patented proposals for nursing bottle holders employing a flexible stem and a bottle retainer to hold the bottle for the infant. These suffer from various deficiencies. One problem is that they do not address the possibility of the infant choking on milk.

SUMMARY OF THE INVENTION

A nursing bottle holder is provided with this invention that allows the infant to nurse without direct attendance, and also reduces the chances of choking. The bottle holder includes an inclined wall which serves as a back support. This wall is supported above a level surface at an inclined angle. A flexible stem with a bottle retainer is positioned in front of the baby. The baby lies generally on his side, being supported by the wall. This positioning reduces the chances of the baby from choking.

In the preferred embodiment, a horizontal support extends forwardly from the wall, resulting in an obtuse angle at its intersection with the wall. The baby lies at this angled intersection and is partially supported on the horizontal support and the wall. Also, preferably the wall is part of a compartment for storing the flexible stem and bottles.

DESCRIPTION OF THE PREFERRED EMBODIMENT

Figure 1:
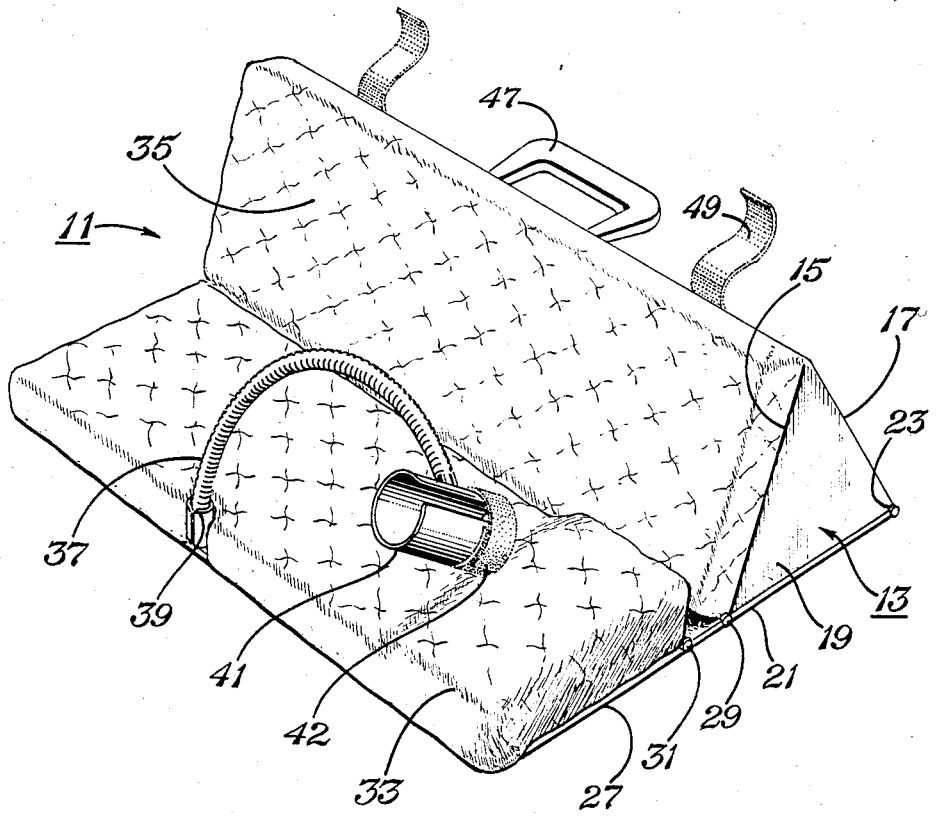
FIG. 1 is a perspective view of a bottle holder constructed in accordance with this invention.
Figure 2:
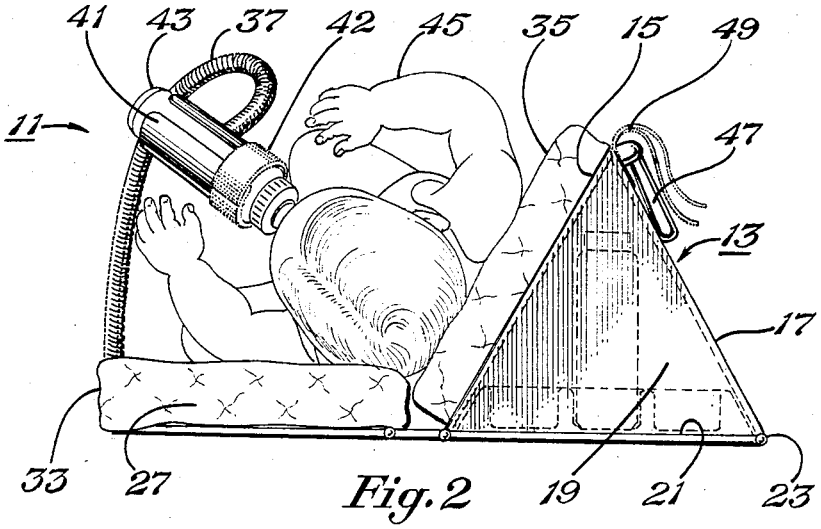
FIG. 2 is a side view of the bottle holder in FIG. 1, showing an infant nursing.

Referring to FIGS. 1 and 2, bottle holder 11 is shown in a position for nursing. Bottle holder 11 includes a compartment 13 that is shaped in generally triangular configuration in transverse cross-section. Compartment 13 has a rectangular front wall 15 and a rectangular rear wall 17. The front wall 15 and the rear wall 17 are rigidly connected together at their upper ends. The front wall 15 and the rear wall 17 have an included angle between them of about 60 degrees. Closed ends 19 are located on each edge of the front wall 15 and the rear wall 17. Each end 19 is a triangular flat member rigidly joined to the walls 15 and 17. The rear wall 17 serves as support means for supporting the front wall 15 at an inclination relative to level surface.

Figure 4:
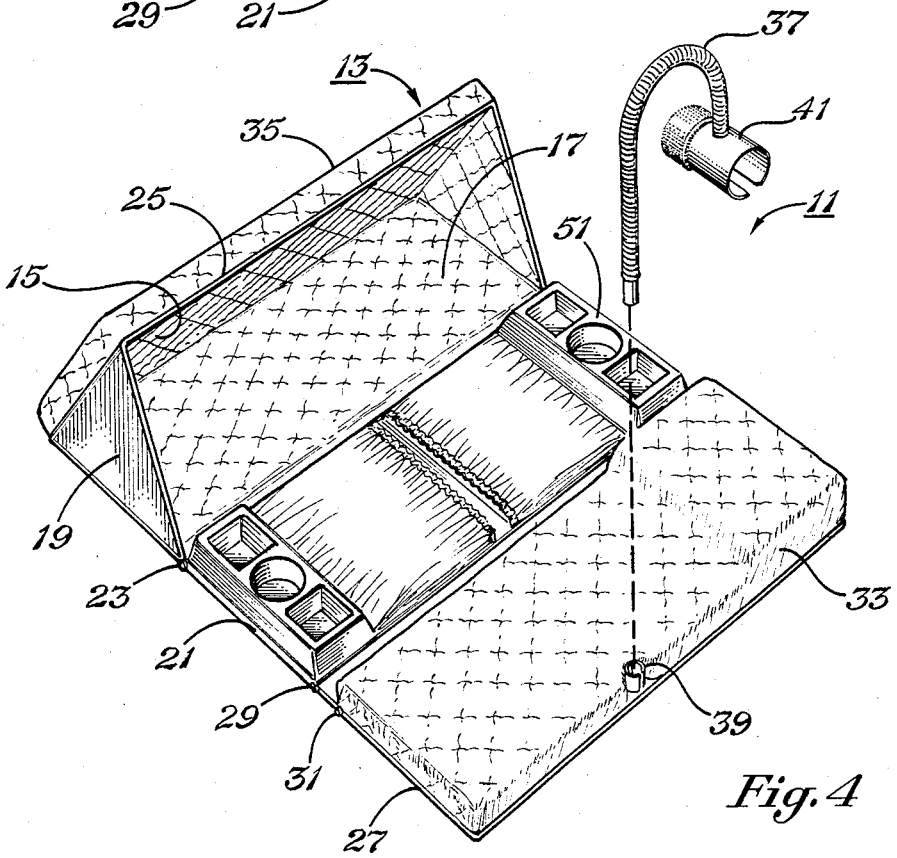
FIG. 4 is a perspective view of the bottle holder of FIG. 1, showing the holder in an open position.

Compartment 13 also includes a bottom or base 21 as shown in FIGS. 2 and 4. Base 21 is a flat rectangular member of approximately the same dimensions as the front wall 15 and rear wall 17. Base 21 is adapted to rest on a level surface. The rear wall 17 is joined to the base 21 by a hinge 23. Hinge 23 serves as means to allow the compartment 13 to move between the closed position shown in FIG. 2 to the open position shown in FIG. 4. In the closed position, both walls 15 and 17 will form an angle of about 60 degrees with respect to the base 21. The lower edges 25 (FIG. 4) of the front wall 15 and ends 19 will be overlying and in contact with the base 21. In the open position shown in FIG. 4, the lower edges 25 are pivoted upright. The rear wall 17 is coplanar with the base 21 in the open position. This exposes the compartment 13 for access to the contents.

Referring again to FIG. 1, the bottle holder 11 also includes a horizontal support 27. Horizontal support 27 is a rectangular flat member approximately the same dimension as the walls 15 and 17 and the base 21. Horizontal support 27 is connected to the forward edge of the base 21 (FIG. 2) by means of two hinges 29 and 31. Hinges 29 and 31 are parallel with hinge 23. Hinges 29 and 31 serve as means to allow the horizontal support 27 to move between the open position shown in FIG. 1 to the folded position shown in FIG. 3. In the open position, the horizontal support 27 extends forwardly from the base 21 and is coplanar with the base 21. Also, in the open position and with the compartment 13 in the closed position, as shown in FIG. 1, an obtuse angle will exist between the intersection of the front wall 15 and the horizontal support 27. In the folded position shown in FIG. 3, the horizontal support 27 will overlie and be parallel with the front wall 15.

The horizontal support 27 has a cushion 33 which is secured to it. A cushion 35 is secured to the front wall 15. A flexible stem 37 is releasably secured in a socket 39 located in the horizontal support 27. Stem 37 is a flexible member of a type that can be twisted into various shapes, and will retain that shape until moved again. This type of member is commonly used with lamps. The lower end of stem 37 seats and is secured into socket 39 by conventional means that requires some rotational movement such as slots and lugs (not shown).

The proximal or free end of stem 37 has secured rigidly to it a bottle retainer 41. Bottle retainer 41 may be of various types. In the embodiment shown, it includes a flexible split sleeve which is secured by a strap 42 of Velcro material. The retainer 41 will hold a bottle 43 in place when secured by strap 42 as shown in FIG. 2. The flexible stem 37 allows the bottle 43 to be oriented in front of the infant 45 so that the infant 45 can drink unattended from the bottle 43 as shown in FIG. 2. The socket 39 is positioned near the forward edge of the horizontal support 27 so that the infant 45 will be located between the stem 37 and the front wall 15.

Figure 3:
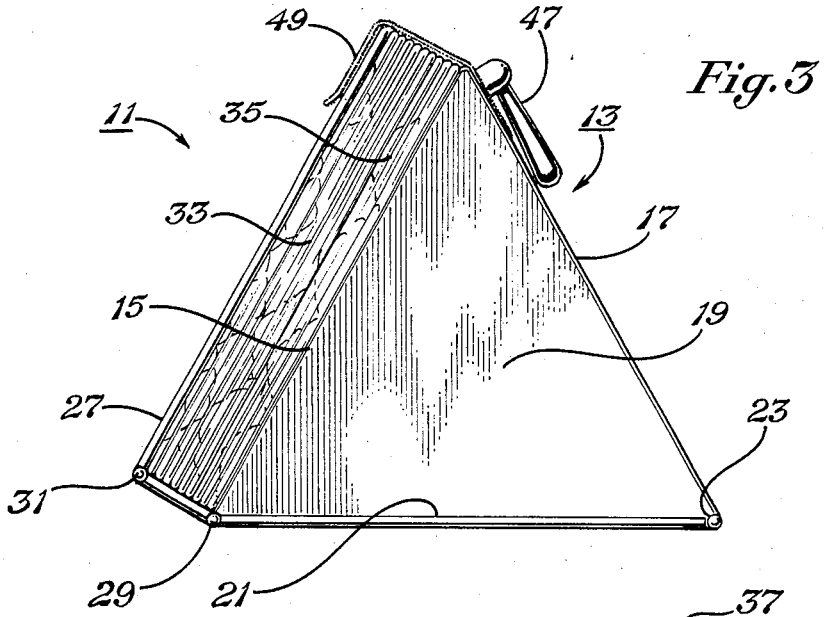
FIG. 3 is an side view of the bottle holder in FIG. 1, showing the bottle holder in the folded or storage position.

As shown in FIGS. 1–3, a handle 47 is mounted to the upper edge of the rear wall 17. Also, Velcro straps 49 are mounted to the upper edge of the rear wall 17. These straps can be secured to mating members (not shown) on the horizontal support 27 to secure the bottle holder 11 in the closed position as shown in FIG. 3. Referring also to FIG. 4, the base 21 preferably has receptacles 51 located therein for holding one or more bottles 43.

In operation, the bottle holder 11 will be normally transported as shown in FIG. 3. The stem 37 and retainer 41 will be removed from socket 39 (FIG. 1) and stowed inside the compartment 13. The compartment 13 may also contain one or more bottles. The bottle holder 11 may be easily carried by using the handle 47.

When it is desired to feed the baby, the straps 49 are released and the horizontal support 27 is folded to the position where it is coplanar with the base 21 as shown in FIGS. 1 and 2. The compartment 13 is opened, as shown in FIG. 3, and the bottles 43, stem 37 and retainer 41 (FIG. 1) are removed. The compartment 13 is then closed so that the front wall 15 will be inclined relative to the horizontal support 27 as shown in FIG. 2. The infant 45 is placed on the cushions 33 and 35. The is placed on his side, with the infant's back in contact with the cushion 33 and one side in contact with the cushion 35. This orients the infant generally on his side, so that he does not face directly upward, rather faces to one side.

The bottle 43 is placed in the retainer 41 and the stem 37 is moved over to a position where the infant can easily reach the bottle 43 with his mouth. The infant 45 may then be left while he drinks from the bottle 43. Should any milk spill from around the infant's mouth, it will not run into his ears, because he will not be flat on his back, rather will be oriented on his side. Also, lying on his side will reduce the chance from the infant choking, since any excess fluid will run off onto the cushion 33.

After the infant completes feeding, the stem 37 may be removed. The compartment 13 is tilted back and the stem placed inside. Also, for travelling, bottles may be placed in the compartment 13. The horizontal support 27 is then folded up to the position shown in FIG. 3, and the straps 49 will secure it in place.

The invention has significant advantages. The bottle holder allows the infant to safely and easily feed while the parents are occupied with other tasks. Because of the inclination of the infant, the chances for choking are reduced. The bottle holder further has the advantage of having an integral compartment for carrying articles.

While the invention has been shown in only one of its forms, it should be apparent to those skilled in the art that it is not so limited, but is susceptible to various changes without departing from the scope of the invention.

I claim:

1. An apparatus for placement on a level surface for bottle feeding an infant, comprising in combination:

a compartment having a closed position and an open position, the compartment having a flat base for placing on the level surface, a front wall located on a forward edge of the base which inclines upwardly relative to the base at an acute angle when the compartment is in a closed position, a rear wall which extends from the upper edge of the front wall downward to the base when the compartment is in the closed position, and closed ends at each side edge of the front wall, rear wall and base, defining a container for storage of articles relative to infant feeding;

a horizontal support;

mounting means for securing the horizontal support to the forward edge of the base for locating the horizontal support coplanar with the base and intersecting the front wall at an obtuse angle, for supporting the infant generally on his side with his back in contact with the front wall at the junction of the horizontal support and the front wall;

a flexible stem having a free end and carried by the apparatus for positioning the free end in front of the infant; and retainer means attached to the free end of the neck for holding a bottle in front of the infant in a position to allow the infant to drink from the bottle while supported generally on his side by the front wall.

2. The apparatus according to claim 1 wherein the mounting means comprises hinge means connected between the base and horizontal support for allowing the horizontal support to be folded between an extended position coplanar with the base to a folded position parallel with and overlying the front wall.

3. The apparatus according to claim 1 wherein the rear wall is secured at its lower edge to a rearward edge of the base by hinge means for allowing the rear wall, front wall and closed ends to pivot relative to the base between the closed position in which the rear wall extends upwardly from the base and the closed ends and front wall overlie the base to close the compartment, to the open position in which the rear wall is coplanar with the base, and the lower edges of the closed ends and the front wall extend upwardly, to provide access to the compartment.

4. The apparatus according to claim 1 further comprising cushion means on the horizontal support and front wall for cushioning the infant while supported on the horizontal support and front wall.

* * * * *